US010290282B2

(12) United States Patent
Peng et al.

(10) Patent No.: US 10,290,282 B2
(45) Date of Patent: May 14, 2019

(54) DISPLAY APPARATUS AND BRIGHTNESS ADJUSTMENT METHOD THEREOF

(71) Applicant: Wuhan China Star Optoelectronics Technology Co., Ltd., Wuhan, Hubei (CN)

(72) Inventors: Haibo Peng, Guangdong (CN); Dejiun Li, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 117 days.

(21) Appl. No.: 15/321,853

(22) PCT Filed: Oct. 10, 2016

(86) PCT No.: PCT/CN2016/101613

§ 371 (c)(1),
(2) Date: Dec. 23, 2016

(87) PCT Pub. No.: WO2018/040227

PCT Pub. Date: Mar. 8, 2018

(65) Prior Publication Data

US 2018/0211633 A1 Jul. 26, 2018

(30) Foreign Application Priority Data

Aug. 30, 2016 (CN) ..... 2016 1 0775996

(51) Int. Cl.
*G09G 5/10* (2006.01)

(52) U.S. Cl.
CPC ..... *G09G 5/10* (2013.01); *G09G 2320/0673* (2013.01)

(58) Field of Classification Search
CPC ..... G09G 5/10; G09G 2320/0673
See application file for complete search history.

(56) References Cited

U.S. PATENT DOCUMENTS 6,043,797 A 3/2000 Clifton
7,439,985 B2 * 10/2008 Li ..... G09G 3/3607 345/600
9,466,237 B2 * 10/2016 Kim ..... G09G 3/2044
9,659,520 B2 * 5/2017 Hsiao ..... G09G 3/2007
(Continued)

FOREIGN PATENT DOCUMENTS

CN 1606331 A 4/2005
CN 1637823 A 7/2005
(Continued)

*Primary Examiner* — Peter D McLoone
(74) *Attorney, Agent, or Firm* — Andrew C. Cheng

(57) ABSTRACT

The present application discloses a display apparatus and the brightness adjustment method thereof, the display apparatus includes a plurality of pixel units, each pixel unit includes a red sub-pixel, a green sub-pixel, a blue sub-pixel, and a white sub-pixel, wherein the method includes: acquiring a standard GAMMA curve for adjusting the brightness of the display apparatus, the GAMMA value of the standard GAMMA curve is $\gamma_0$; acquiring a green GAMMA curve corresponding to the green sub-pixel, the GAMMA value of the green GAMMA curve is $\gamma_G$; adjusting the green GAMMA curve to deviate from the standard GAMMA curve and to enhance the gray-scale brightness of the green sub-pixel, wherein $\gamma_G<\gamma_0$; and wherein the color gamut of the display apparatus is more than 77% of the NTSC color gamut.

14 Claims, 2 Drawing Sheets

(56) References Cited

U.S. PATENT DOCUMENTS

2005/0200580 A1* 9/2005 Li ..... G09G 3/3607 345/88
2005/0201615 A1 9/2005 Hsu
2008/0303836 A1* 12/2008 Ludden ..... G09G 3/2092 345/531
2012/0133681 A1* 5/2012 Hsiao ..... G09G 3/2007 345/690
2012/0169780 A1* 7/2012 Park ..... G09G 5/10 345/690
2012/0320096 A1* 12/2012 Small ..... G09G 3/2003 345/690
2013/0147857 A1* 6/2013 Kurikko ..... G09G 3/20 345/690
2015/0179094 A1* 6/2015 Kim ..... G09G 3/2044 345/690
2015/0181182 A1* 6/2015 Lin ..... H04N 9/3182 348/453
2015/0348500 A1* 12/2015 Lin ..... G09G 3/3406 345/600
2015/0371579 A1* 12/2015 Yu ..... G09G 3/32 345/690
2016/0267631 A1* 9/2016 Shen ..... G06T 5/009
2016/0284284 A1* 9/2016 Liu ..... G09G 3/3607
2016/0314728 A1* 10/2016 Ding ..... G09G 3/006
2017/0263209 A1* 9/2017 Ding ..... G09G 5/10

FOREIGN PATENT DOCUMENTS

CN 1697009 A 11/2005
CN 101533599 A 9/2009
CN 1980400 A 6/2013
CN 103390395 A 11/2013
CN 105185311 A 12/2015
CN 105280124 A 1/2016
CN 105895051 A 8/2016
KR 20080060942 A 7/2008

* cited by examiner

DISPLAY APPARATUS AND BRIGHTNESS ADJUSTMENT METHOD THEREOF

FIELD OF THE INVENTION

The present application relates to a display apparatus technology field, and more particularly to a display apparatus and brightness adjustment method thereof.

BACKGROUND OF THE INVENTION

With the increase in resolution of mobile phones, aperture rate of panel is getting lower and lower, in order to maintain the luminance required to meet consumers' needs, the luminance of the backlight needs to be continuously enhanced, but the problem brought by enhancing the backlight brightness is the power consumption of backlight is getting larger and larger, and the product's battery life is reduced. One technology solution to solve this problem is to adapt a pixel unit structure with four sub-pixels in a display apparatus, that is, each pixel unit includes a red sub-pixel R, a green sub-pixel G, a blue sub-pixel B, and a white sub-pixel W. Comparing to the conventional pixel unit, this structure adds the white sub-pixel W, by using color resist material of transparent material having a more than 99% transmittance, increasing the transmittance of each pixel unit as a whole, thereby the number of light sources in the backlight can be reduced, and the backlight power consumption has also been significantly reduced.

However, the actual display of the display apparatus is more often a color image, such as a character, scenery or the like. In this case, since ¼ region is occupied by the white sub-pixel W in the RGBW pixel structure, and the luminance of the backlight is low, the color (R+G+B) image is presented a certain degree of darkness, besides, due to the presence of the white sub-pixel W will cause the appearance of color to be diluted, such as dark red to light red, which is the display quality of the RGBW pixel structure product need to be improved.

SUMMARY OF THE INVENTION

In view of the insufficient of the conventional technology, the present application provides a brightness adjusting method of a display apparatus for improving a problem that a display apparatus with RGBW pixel structure is dimmed in displaying a color image.

In order to achieve the above-mentioned purpose, the present application adopts the following technical approach:

A brightness adjusting method for a display apparatus, the display apparatus including a plurality of pixel units, each of the pixel unit including a red sub-pixel, a green sub-pixel, a blue sub-pixel, and a white sub-pixel, wherein the method including:

acquiring a standard GAMMA curve for adjusting the brightness of the display apparatus, the GAMMA value of the standard GAMMA curve is $\gamma_0$; acquiring a green GAMMA curve corresponding to the green sub-pixel, the GAMMA value of the green GAMMA curve is $\gamma_G$; adjusting the green GAMMA curve to deviate from the standard GAMMA curve and to enhance the gray-scale brightness of the green sub-pixel, wherein $\gamma_G<\gamma_0$; and wherein the color gamut of the display apparatus is more than 77% of the NTSC color gamut. Wherein $\gamma_0$ is: =2.2, $1\leq\gamma_G<2.2$.

Further, acquiring a red GAMMA curve corresponding to the red sub-pixel, the GAMMA value of the red GAMMA curve is $\gamma_R$; adjusting the red GAMMA curve to deviate from the standard GAMMA curve and to enhance the gray-scale brightness of the red sub-pixel, wherein $\gamma_R<\gamma_0$ and it meets $\gamma_G<\gamma_R<\gamma_0$.

Wherein $\gamma_0$=2.2, $1\leq\gamma_G<2.2$, $1.6\leq\gamma_R<2.2$, and the range of values of $\gamma_G$ and $\gamma_R$ meet the condition of $\gamma_G<\gamma_R$.

Further, acquiring a blue GAMMA curve corresponding to the blue sub-pixel, the GAMMA value of the blue GAMMA curve is $\gamma_B$; adjusting the blue GAMMA curve to deviate from the standard GAMMA curve and to enhance the gray-scale brightness of the blue sub-pixel, wherein $\gamma_B<\gamma_0$, and the range of values meet the condition of $\gamma_G<\gamma_R<\gamma_B<\gamma_0$.

Wherein $\gamma_0$=2.2, $1\leq\gamma_G<2.2$ , $1.6\leq\gamma_R<2.2$ , $1.8\leq\gamma_B<2.2$, and the range of values $\gamma_G$, $\gamma_R$ and $\gamma_B$ meet the condition of $\gamma_G<\gamma_R<\gamma_B$.

Wherein $\gamma_0$ is: =2.2, $1.8\leq\gamma_G<2.2$, $1.8\leq\gamma_R<2.2$, and the range of values $\gamma_G$, $\gamma_R$ and $\gamma_B$ meet the condition of $\gamma_G<\gamma_R<\gamma_B$.

In another preferred technical approach provides a brightness adjustment method for a display apparatus, the display apparatus including a plurality of pixel units, each pixel unit including a red sub-pixel, a green sub-pixel, a blue sub-pixel, and a white sub-pixel, wherein the method including: acquiring a standard GAMMA curve for adjusting the brightness of the display apparatus, the GAMMA value of the standard GAMMA curve is $\gamma_0$; combining the red sub-pixel and the green sub-pixel as a yellow sub-pixel; acquiring the yellow GAMMA curve corresponding to the yellow sub-pixel, the GAMMA value of the yellow GAMMA curve is $\gamma_Y$; adjusting the yellow GAMMA curve to deviate from the standard GAMMA curve and to enhance the gray-scale brightness of the red sub-pixel R and the green sub-pixel G, wherein $\gamma_Y<\gamma_0$; wherein $\gamma_0$=2.2, $1\leq\gamma_Y<2.2$; and wherein the color gamut of the display apparatus is more than 77% of the NTSC color gamut.

Further, acquiring a blue GAMMA curve corresponding to the blue sub-pixel, the GAMMA value of the blue GAMMA curve is $\gamma_B$; adjusting the blue GAMMA curve to deviate from the standard GAMMA curve and to enhance the gray-scale brightness of the blue sub-pixel, wherein $\gamma_B<\gamma_0$, and the range of values meet the condition of $\gamma_Y<\gamma_B<\gamma_0$; and wherein $1.8\leq\gamma_B<2.2$.

In another preferred technical approach provides a display apparatus, including a display panel, and the display apparatus including a plurality of pixel units, each pixel unit including a red sub-pixel, a green sub-pixel, a blue sub-pixel, and a white sub-pixel: wherein the display apparatus further including a standard GAMMA module and a GAMMA adjustment module, the standard GAMMA module is configured to acquire a standard GAMMA curve to adjust the brightness of the display apparatus, the GAMMA adjustment module is configured to acquire a GAMMA curve of each sub-pixels of the colors, and to adjust the GAMMA curves of each sub-pixels of the colors to deviate from the standard GAMMA curve to enhance the gray-scale brightness of the corresponding sub-pixels of the colors.

Advantage:

The display apparatus and the brightness adjustment method thereof provided in the present application is focus on the display apparatus having the RGBW pixel units, by adjusting the GAMMA curve of the RGB sub-pixels of the three colors to deviate from the standard GAMMA curve for enhancing the gray-scale brightness of the corresponding sub-pixel of the colors and to improve the dimmed problem when display the color image of the display apparatus having the RGBW pixel structure. Wherein the gray-scale brightness of the green sub-pixel has the largest increase range, the gray-scale brightness of the blue sub-pixel is relatively small, at the same time, in achieving the gray-scale brightness, it is possible to avoid the problem occurred of the gray-scale discontinuity felt by the human eye due to the deviation of the GAMMA curve of the colors from the standard GAMMA curve.

BRIEF DESCRIPTION OF THE DRAWINGS

In order to more clearly illustrate the embodiments of the present application or prior art, the following figures will be described in the embodiments are briefly introduced. It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. Based on the embodiments of the present application, all other embodiments to those of ordinary skill in the premise of no creative efforts acquired should be considered within the scope of protection of the present application.

Specifically, the terminologies in the embodiments of the present application are merely for describing the purpose of the certain embodiment, but not to limit the invention.

Embodiments and the claims be implemented in the present application requires the use of the singular form of the book "an", "the" and "the" are intend to include most forms unless the context clearly dictates otherwise. It should also be understood that the terminology used herein that "and/or" means and includes any or all possible combinations of one or more of the associated listed items.

It is to be noted here that in order to avoid obscuring the present invention with unnecessary detail, only the structure and/or processing steps closely related to the approach according to the invention are shown in the accompanying drawings, other details of the present invention not closed to the present application is omitted.

Figure 1:
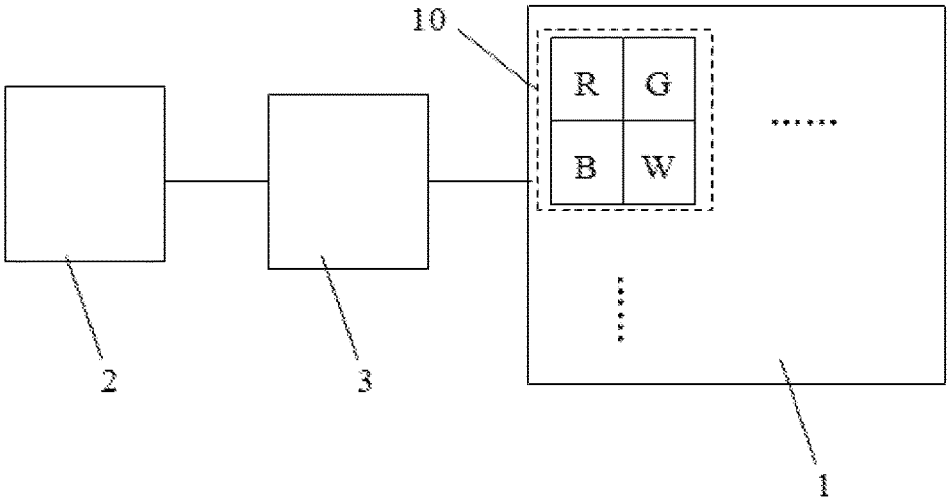
FIG. 1 is a schematic structural view of a display apparatus according to an embodiment of the present application.

Embodiment 1:

As shown in FIG. 1, the present embodiment first provides a display apparatus, the display apparatus includes a display panel 1, in which a plurality of pixel units 10 are provided in the display panel 1, each pixel unit includes a red sub-pixel R, a green sub-pixel G, a blue sub-pixel B, and a white sub-pixel W, i.e., the display panel 1 is a display panel having the RGBW pixel structure.

The display apparatus further includes a standard GAMMA module 2 and a GAMMA adjustment module 3 for adjusting the display brightness of the pixel unit 10 provided in the display panel 1. Wherein, the standard GAMMA module 2 is configured to acquire a standard GAMMA curve to adjust the brightness of the display apparatus, the GAMMA adjustment module 3 is configured to acquire a GAMMA curve of each sub-pixels of the colors, and to adjust the GAMMA curves of each sub-pixels of the colors to deviate from the standard GAMMA curve to enhance the gray-scale brightness of the corresponding sub-pixels of the colors and to improve the dimmed problem when display the color image of the display apparatus having the RGBW pixel structure.

Specifically, the brightness adjustment method of the display apparatus as described above includes:

A standard GAMMA curve for adjusting the brightness of the display apparatus is acquired by the standard GAMMA module 2, and the GAMMA value of the standard GAMMA curve is $\gamma_0$.

The green GAMMA curve corresponding to the green sub-pixel G is acquired by the GAMMA adjustment module 3, and the GAMMA value of the green GAMMA curve is $\gamma_G$.

The green GAMMA curve is adjusted to deviate from the standard GAMMA curve to enhance the gray-scale brightness of the green sub-pixel G; The red GAMMA curve corresponding to the red sub-pixel R is acquired, and the GAMMA value of the red GAMMA curve is $\gamma_R$. The red GAMMA curve is adjusted to deviate from the standard GAMMA curve to enhance the gray-scale brightness of the red sub-pixel R; The blue GAMMA curve corresponding to the blue sub-pixel B is acquired, and the GAMMA value of the blue GAMMA curve is $\gamma_B$. The blue GAMMA curve is adjusted to deviate from the standard GAMMA curve to enhance the gray-scale brightness of the blue sub-pixel B.

Figure 2:
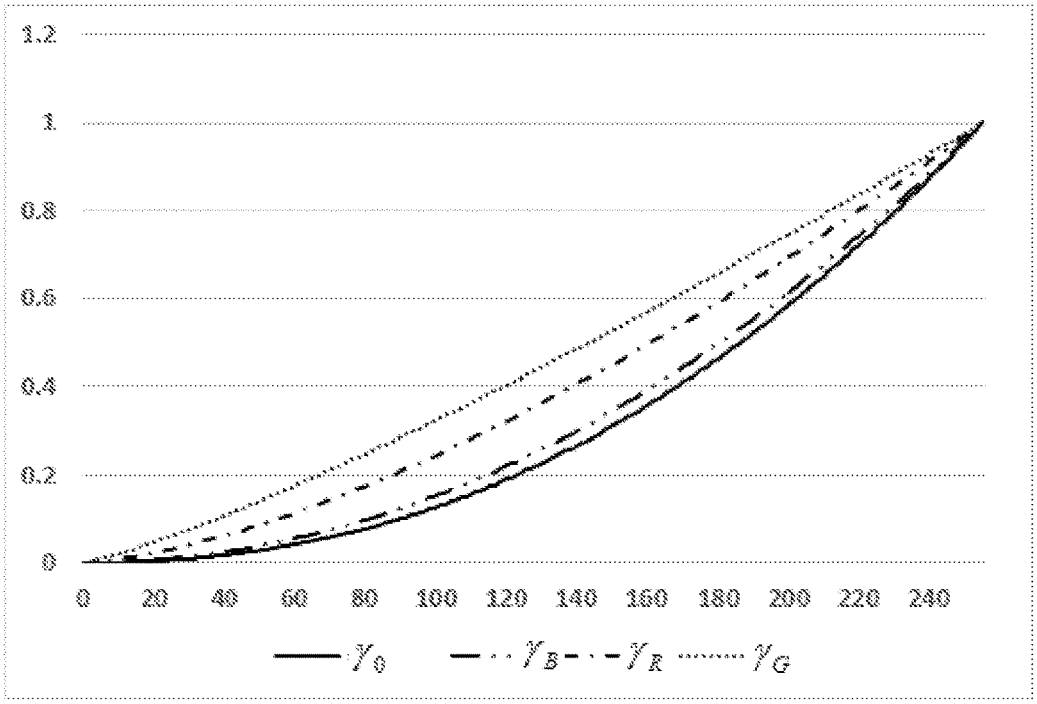
FIG. 2 is a schematic diagram illustrates the GAMMA curve of the sub-pixel deviating from the standard GAMMA curve in the first embodiment.

Wherein, as illustrated in FIG. 2, the adjusted green GAMMA curve in the present embodiment (the curve $\gamma_G$ in FIG. 2), the adjusted red GAMMA curve in the present embodiment (the curve $\gamma_R$ in FIG. 2), adjusted blue GAMMA curve in the present embodiment (the curve $\gamma_B$ in FIG. 2) are corresponding deviated from the standard GAMMA curve (the curve $\gamma_0$ in FIG. 2). In the present embodiment, by the simultaneously adjustment of the green GAMMA curve, the red GAMMA curve, and the blue GAMMA curve, so that the GAMMA curves of the three colors are deviated from the standard GAMMA curve. It should be noted that, in other embodiments, only the green GAMMA curve or only the green GAMMA curve and the red GAMMA curve can be adjusted.

Wherein, as illustrated in FIG. 2, the trend on the whole for the adjustment of the green GAMMA curve, the red GAMMA curve and the blue GAMMA curve meets the requirement as follows:. $\gamma_G<\gamma_R<\gamma_B<\gamma_0$. If only the green GAMMA curve is adjusted, it needs to be meet: $\gamma_G<\gamma_0$. If only the green GAMMA curve and the red GAMMA curve are adjusted, it needs to be meet: $\gamma_G<\gamma_R<\gamma_0$. The gray-scale brightness of the green sub-pixel G has the largest increase range, the gray-scale brightness of the blue sub-pixel B is relatively small, at the same time, in achieving the gray-scale brightness, it is possible to avoid the problem occurred of the gray-scale discontinuity felt by the human eye due to the deviation of the GAMMA curve of the colors from the standard GAMMA curve.

In the present embodiment, the value of $\gamma_0$ is: =2.2, and the range of values of $\gamma_G$, $\gamma_R$ and $\gamma_B$ are: $1\leq\gamma_G<2.2$ , $1.6\leq\gamma_R<2.2$ , $1.8\leq\gamma_B<2.2$, respectively. More preferably, the range of values of $\gamma_G$ and $\gamma_R$ and $\gamma_B$ are: $1.8\leq\gamma_G<2.2$, $1.8\leq\gamma_R<2.2$, $1.8\leq\gamma_B<2.2$, respectively. Wherein, in the ranges described above, the specific range of values of$\gamma_G$, $\gamma_R$ and $\gamma_B$ need to meet the conditions : $\gamma_G<\gamma_R<\gamma_B<\gamma_0$.

Further, in view of the RGBW pixel structure to display the color image, the W pixels are on to a certain extent, resulting in diluting the image color. Therefore, the display apparatus having the RGBW pixel structure needs to satisfy the following relation in color gamut range in order to achieve the color display capability close to the RGB pixel structure: NTSC: RGBW>RGB.

By measuring in 24 colors defined by the standard sRGB color gamut space, the surrounded area of the color displayed by the RGBW is approximately 92% of that of RGB, therefore, it needs to set the color gamut of the RGBW pixel structure to 1/0.92=1.09 times of the RGB pixel structure. Taking RGB is 70.8% NTSC as an example, if the RGBW pixel structure need to achieve a similar color effect, the color gamut needs to be raised to 70.8%*1.09=77%. Therefore, the color gamut of the display apparatus provided by the present embodiment is more than 77% of the NTSC color gamut.

Embodiment 2:

The difference of the present embodiment and the first embodiment is: in the present embodiment, the brightness adjustment method of the display apparatus includes:

A standard GAMMA curve for adjusting the brightness of the display apparatus is acquired by the standard GAMMA module 2, and the GAMMA value of the standard GAMMA curve is $\gamma_0$.

The GAMMA adjustment module 3 regards the combination of the red sub-pixel R and the green sub-pixel G as a yellow sub-pixel; A yellow GAMMA curve corresponding to the yellow sub-pixel is acquired by the GAMMA adjustment module 3, and the GAMMA value of the yellow GAMMA curve is $\gamma_Y$. The yellow GAMMA curve is adjusted to deviate from the standard GAMMA curve to enhance the gray-scale brightness of the red sub-pixel R and the green sub-pixel G.

Figure 3:
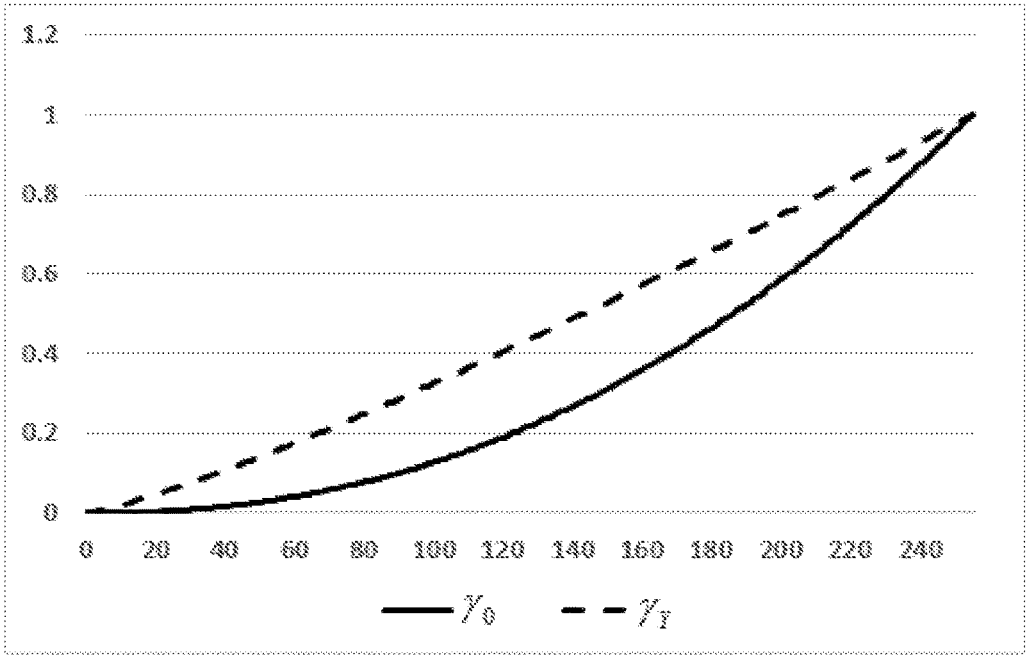
FIG. 3 is a schematic diagram illustrates the GAMMA curve of the sub-pixel deviating from the standard GAMMA curve in the second embodiment.

Wherein, as illustrated in FIG. 3, the adjusted yellow GAMMA curve in the present embodiment (the curve $\gamma_Y$.in FIG. 3) is deviated from the standard GAMMA curve (the curve $\gamma_0$ FIG. 3). For the adjustment of the yellow GAMMA curve meets the requirement as: $\gamma_Y<\gamma_0$.

In the present embodiment, the value of $\gamma_0$ is: =2.2, and the range of values of $\gamma_Y$ is: $1\leq\gamma_Y<2.2$. More preferably, the range of values of $\gamma_Y$ is: $1.8\leq\gamma_Y<2.2$.

As described above, the display apparatus and the brightness adjustment method thereof provided in the present application is focus on the display apparatus having the RGBW pixel units, by adjusting the GAMMA curve of the RGB sub-pixels of the three colors to deviate from the standard GAMMA curve for enhancing the gray-scale brightness of the corresponding sub-pixel of the colors and to improve the dimmed problem when display the color image of the display apparatus having the RGBW pixel structure. Wherein the gray-scale brightness of the green sub-pixel has the largest increase range, the gray-scale brightness of the blue sub-pixel is relatively small, at the same time, in achieving the gray-scale brightness, it is possible to avoid the problem occurred of the gray-scale discontinuity felt by the human eye due to the deviation of the GAMMA curve of the colors from the standard GAMMA curve.

It should be noted that in this context relational terms such as first and second are used merely to distinguish one entity or operation from another entity or operation without necessarily requiring or implying that such entity or operation between any such actual relationship or order. Or any other variation thereof is intended to encompass a non-exclusive inclusion such that a process, method, article, or device that includes a set of elements includes not only those elements but also those that are not explicitly listed, such as "comprising" or "including" may also include elements inherent to such processes, methods, articles, or devices. Without limiting more, the elements defined by the phrase "comprising one" do not preclude the presence of additional identical elements in the process, method, article, or apparatus that includes the elements.

Above are embodiments of the present application, which does not limit the scope of the present application. Any modifications, equivalent replacements or improvements within the spirit and principles of the embodiment described above should be covered by the protected scope of the invention.

What is claimed is:

1. A brightness adjustment method for a display apparatus, the display apparatus comprising a plurality of pixel units, each pixel unit comprising a red sub-pixel, a green sub-pixel, a blue sub-pixel, and a white sub-pixel, wherein the method comprising:

acquiring a standard GAMMA curve for adjusting the brightness of the display apparatus, the GAMMA value of the standard GAMMA curve is $\gamma_0$;

acquiring a green GAMMA curve corresponding to the green sub-pixel, the GAMMA value of the green GAMMA curve is $\gamma_G$;

adjusting the green GAMMA curve to deviate from the standard GAMMA curve and to enhance the gray-scale brightness of the green sub-pixel, wherein $\gamma_G<\gamma_0$;

acquiring a red GAMMA curve corresponding to the red sub-pixel, the GAMMA value of the red GAMMA curve is $\gamma_R$;

adjusting the red GAMMA curve to deviate from the standard GAMMA curve and to enhance the gray-scale brightness of the red sub-pixel, wherein $\gamma_R<\gamma_0$ and it meets $\gamma_G<\gamma_R<\gamma_0$; and wherein the color gamut of the display apparatus is more than 77% of the NTSC color gamut.

2. The brightness adjustment method for a display apparatus according to claim 1, wherein $\gamma_0$ is: =2.2, $1\leq\gamma_G<2.2$.

3. The brightness adjustment method for a display apparatus according to claim 1, wherein $\gamma_0$=2.2, $1\leq\gamma_G\leq2.2$, $1.6\leq\gamma_R<2.2$, and the range of values of $\gamma_G$ and $\gamma_R$ meet the condition of $\gamma_G<\gamma_R$.

4. The brightness adjustment method for a display apparatus according to claim 3, further comprising:

acquiring a blue GAMMA curve corresponding to the blue sub-pixel, the GAMMA value of the blue GAMMA curve is $\gamma_B$;

adjusting the blue GAMMA curve to deviate from the standard GAMMA curve and to enhance the gray-scale brightness of the blue sub-pixel, wherein $\gamma_B<\gamma_0$, and the range of values meet the condition of $\gamma_G<\gamma_R<\gamma_B<\gamma_0$.

5. The brightness adjustment method for a display apparatus according to claim 4, wherein $\gamma_0$ is: =2.2, $1\leq\gamma_G<2.2$, $1.6\leq\gamma_R<2.2$, $1.8\leq\gamma_B<2.2$, and the range of values $\gamma_G$, $\gamma_R$ and $\gamma_B$ meet the condition of $\gamma_G<\gamma_R<\gamma_B$.

6. The brightness adjustment method for a display apparatus according to claim 5, wherein $\gamma_0$ is: =2.2, $1.8\leq\gamma_G<2.2$, $1.8\leq\gamma_R<2.2$, and the range of values $\gamma_G$, $\gamma_R$ and $\gamma_B$ meet the condition of $\gamma_G<\gamma_R<\gamma_B$.

7. A brightness adjustment method for a display apparatus, the display apparatus comprising a plurality of pixel units, each pixel unit comprising a red sub-pixel, a green sub-pixel, a blue sub-pixel, and a white sub-pixel, wherein the method comprising:

acquiring a standard GAMMA curve for adjusting the brightness of the display apparatus, the GAMMA value of the standard GAMMA curve is $\gamma_0$;

combining the red sub-pixel and the green sub-pixel as a yellow sub-pixel;

acquiring the yellow GAMMA curve corresponding to the yellow sub-pixel, the GAMMA value of the yellow GAMMA curve is $\gamma_Y$;

adjusting the yellow GAMMA curve to deviate from the standard GAMMA curve and to enhance the gray-scale brightness of the red sub-pixel R and the green sub-pixel G, wherein $\gamma_Y<\gamma_0$;

acquiring a blue GAMMA curve corresponding to the blue sub-pixel, the GAMMA value of the blue GAMMA curve is $\gamma_B$;

adjusting the blue GAMMA curve to deviate from the standard GAMMA curve and to enhance the gray-scale brightness of the blue sub-pixel, wherein $\gamma_B\leq\gamma_0$, and the range of values meet the condition of $\gamma_Y<\gamma_B<\gamma_0$;

wherein $\gamma_0=2.2$, $1\leq\gamma_Y<2.2$; and wherein the color gamut of the display apparatus is more than 77% of the NTSC color gamut.

8. The brightness adjustment method for a display apparatus according to claim 7, wherein $1.8\leq\gamma_B<2.2$.

9. A display apparatus, comprising a display panel, and the display apparatus comprising a plurality of pixel units, each pixel unit comprising a red sub-pixel, a green sub-pixel, a blue sub-pixel, and a white sub-pixel:

wherein the display apparatus further comprising a standard GAMMA module and a GAMMA adjustment module, the standard GAMMA module is configured to acquire a standard GAMMA curve to adjust the brightness of the display apparatus, the GAMMA adjustment module is configured to acquire a GAMMA curve of each sub-pixels of the colors, and to adjust the GAMMA curves of each sub-pixels of the colors to deviate from the standard GAMMA curve to enhance the gray-scale brightness of the corresponding sub-pixels of the colors;

wherein the display apparatus adapting a method to adjust brightness, the method comprising:

acquiring a standard GAMMA curve for adjusting the brightness of the display apparatus, the GAMMA value of the standard GAMMA curve is $\gamma_0$;

acquiring a green GAMMA curve corresponding to the green sub-pixel, the GAMMA value of the green GAMMA curve is $\gamma_G$;

adjusting the green GAMMA curve to deviate from the standard GAMMA curve and to enhance the gray-scale brightness of the green sub-pixel, wherein $\gamma_G<\gamma_0$;

acquiring a red GAMMA curve corresponding to the red sub-pixel, the GAMMA value of the red GAMMA curve is $\gamma_R$;

adjusting the red GAMMA curve to deviate from the standard GAMMA curve and to enhance the gray-scale brightness of the red sub-pixel, wherein $\gamma_R<\gamma_0$ and it meets $\gamma_G<\gamma_R<\gamma_0$; and wherein the color gamut of the display apparatus is more than 77% of the NTSC color gamut.

10. The display apparatus according to claim 9, wherein $\gamma_0$ is: $=2.2$, $1\leq\gamma_G<2.2$.

11. The display apparatus according to claim 9, wherein $\gamma_0=2.2$, $1\leq\gamma_G<2.2$, $1.6\leq\gamma_R<2.2$, and the range of values of $\gamma_G$ and $Y_R$ meet the condition of $\gamma_G<\gamma_R$.

12. The display apparatus according to claim 11, further comprising:

acquiring a blue GAMMA curve corresponding to the blue sub-pixel, the GAMMA value of the blue GAMMA curve is $\gamma_B$;

adjusting the blue GAMMA curve to deviate from the standard GAMMA curve and to enhance the gray-scale brightness of the blue sub-pixel, wherein $\gamma_B<\gamma_0$, and the range of values meet the condition of $\gamma_G<\gamma_R<\gamma_B<\gamma_0$.

13. The display apparatus according to claim 12, wherein $\gamma_0$ is: $=2.2$, $1\leq\gamma_G<2.2$, $1.6\leq\gamma_R<2.2$, $1.8\leq\gamma_B<2.2$, and the range of values $\gamma_G$, $\gamma_R$ and $\gamma_B$ meet the condition of $\gamma_G<\gamma_R<\gamma_B$.

14. The display apparatus according to claim 13, wherein $\gamma_0$ is: $=2.2$, $1.8\leq\gamma_G<2.2$, $1.8\leq\gamma_R<2.2$, and the range of values $\gamma_G$, $\gamma_R$ and $\gamma_B$ meet the condition of $\gamma_G<\gamma_R<\gamma_B$.

* * * * *